United States Patent [19]

Meyer

[11] 4,130,400

[45] Dec. 19, 1978

[54] COMBUSTIBLE FUEL SLURRY AND METHOD OF PREPARING SAME

[75] Inventor: Wilfred C. Meyer, Midland, Mich.

[73] Assignee: The Dow Chemical Company, Midland, Mich.

[21] Appl. No.: 866,304

[22] Filed: Jan. 3, 1978

[51] Int. Cl.[2] ..... C10L 1/32

[52] U.S. Cl. ..... 44/51; 44/62; 44/70

[58] Field of Search ..... 44/51, 62, 70; 526/329

[56] References Cited

U.S. PATENT DOCUMENTS

| | | | |
|---|---|---|---|
| 2,430,085 | 11/1947 | Spencer et al. | 44/51 |
| 2,860,109 | 11/1958 | Abel et al. | 526/329 |
| 2,888,340 | 5/1959 | Winnick | 44/62 |
| 2,927,849 | 3/1960 | Greblick et al. | 44/62 |
| 3,192,165 | 6/1965 | Fields et al. | 44/62 |
| 3,241,505 | 3/1966 | Long et al. | 44/51 |

*Primary Examiner*—Winston A. Douglas
*Assistant Examiner*—Y. Harris-Smith
*Attorney, Agent, or Firm*—Lester J. Dankert; Thomas R. Wills

[57] ABSTRACT

Combustible fuel slurries are prepared by admixing solid particulate carbonaceous material, liquid hydrocarbon fuel such as gasoline, fuel oil, and the like, and a particulate cross-linked organic liquid-swellable, organic liquid-insoluble polymer composed of at least 50 mole percent of at least one alkylstyrene. Such slurries are mobile and readily processable in conventional fuel oil transporting, storage, and burning equipment.

10 Claims, No Drawings

COMBUSTIBLE FUEL SLURRY AND METHOD OF PREPARING SAME

BACKGROUND OF THE INVENTION

The present invention relates in general to combustible fuel slurries of solid carbonaceous material in liquid hydrocarbon fuel, and more particularly relates to the modification of such slurries to improve their utility and stability.

It is well known that in certain instances an atomizable liquid fuel offers a marked advantage over a solid fuel. However, the depletion of world liquid fuel reserves threatens the continued use of equipment adapted for such atomizable fuel. In addition, a comparative scarcity of certain liquid fuels in many lands coupled with an abundance of solid carbonaceous fuel has led to experimentation in extending the liquid fuels with solid fuels. Accordingly, attempts have been made to suspend the cheaper and more plentiful solid carbonaceous materials in liquid fuels in such fashion that the slurries could be used in place of the liquid fuels without extensive modification of the conventional equipment used to handle and burn the liquid fuels.

Unless such slurries are treated in some fashion, however, the carbonaceous material will settle out of the slurry over time and form a hard, compact cake at the bottom of the slurry-containing vessel, thereby limiting the utility of the composite fuels. Consequently, many approaches have been suggested to improve the stability and functionality of such composite fuels. One method is simply to grind carbonaceous material such as coal to practically colloidal size before adding it to the liquid fuel. The smallness of size inherently reduces sedimentation. However, this method is cost prohibitive because of the extensive milling required to reduce the particle size to that level.

It was also discovered that the composite fuel could be stabilized by the addition of coal distillates, such as tars and middle fractions, and subjecting the slurry to special heat treatment below the flash point of the mixture. This is inherently a very expensive batch process.

Other materials have also been added to the slurries in attempts to prevent settling of larger than colloidal size particles. Some processes have used fillers such as wood pulp, dust, and waste from starch, flour, and corn factories and others have used substantial amounts of colloidal size particles of coal to stabilize the non-colloidal particles.

Others have used emulsifiers which have generally required, in addition, substantial amounts of water which undesirably reduces the heating value of the fuel and has the potential for corroding the equipment used in handling and burning the slurry. Furthermore, emulsions are easily broken by heating or mechanical agitation and they are generally useful for stabilizing slurries containing only small amounts of coal.

Finally, still others have used additives to thicken and/or gel the composite fuel to prevent sedimentation of the larger coal particles. Casein, gelatin, rubber, and soaps have been used to gel the hydrocarbon. Generally, however, these thickening agents have been employed in such quantity that they undesirably increase the viscosity and substantially decrease the number of uses for the composite fuel.

Accordingly, it would be desirable if a slurry of solid particulate carbonaceous material and liquid hydrocarbon fuel could be treated or modified so as to improve its stability and utility without requiring extensive grinding of the carbonaceous material, addition of water, or thickening of the entire liquid fuel content.

SUMMARY OF THE INVENTION

The present invention provides a fully combustible and essentially mobile fuel slurry comprising solid particulate carbonaceous material, liquid hydrocarbon fuel, and a particulate cross-linked organic liquid-swellable, organic liquid-insoluble polymer, wherein the polymer is composed of at least 50 mole percent of at least one alkylstyrene wherein the alkyl groups contain from 1 to 20 carbon atoms. In one aspect the invention relates to the process for preparing such slurries, and in another aspect relates to such slurries as new composition of matter.

Slurries of the present invention have improved utility and stability compared to unmodified slurries, without requiring excessive grinding of the carbonaceous material, addition of water, or thickening of the total liquid hydrocarbon fuel content. The polymer particles of the present invention effectively interrupt the packing efficiency of any carbonaceous material that settles from the slurries, thereby preventing the formation of a hard, compact cake at the bottom of the slurry-containing vessel. Consequently, the goal of complete slurry stability is no longer a concern as it was in the prior art, since any sediment that forms can be readily redispersed with agitation. Thus, a tremendous ease of processability is gained by the present invention, without a loss of slurry heating value.

DETAILED DESCRIPTION AND EMBODIMENTS

The combustible fuel slurries of the present invention are principally comprised of solid particulate carbonaceous material and liquid hydrocarbon fuel. As used herein, "solid particulate carbonaceous material" shall include such materials as bituminous and anthracite coals, coke, petroleum coke, lignite, charcoal, peat, and combinations thereof. "Liquid hydrocarbon fuel" as used herein shall include crude and refined hydrocarbon based oils, including but not limited to petroleum fuel oils, heavy residual oils and crude oils, and the like.

It is preferred that the particulate carbonaceous material employed in the slurry be powdered or pulverized to a size that will enable at least about 81 percent to pass through a 200 mesh sieve or screen. Such screening produces particles which are relatively small, yet considerably larger than colloidal size. Although the cost of milling carbonaceous material to a size smaller than that suggested here increases dramatically with further grinding, such grinding may be desirable for some users since a slight increase in stability can be obtained by using smaller particles, as shown in the Examples. The upper limit of coal size will be determined by the use of the slurry, e.g., the size that will pass through a burning apparatus.

The amount of particulate carbonaceous material which is added to the liquid hydrocarbon fuel can vary depending upon the user's requirements. For most users, about 5 weight percent of carbonaceous material or less is not normally economically interesting, and when about 60 weight percent or more of carbonaceous material is added the slurry begins to show undesirable flow characteristics. These limits are provided for illustration and guidance, and need not be strictly applied.

The term "organic liquid-insoluble, organic liquid-swellable polymer" as used herein refers to those polymers having the property of being substantially insoluble in, but capable of being swollen by, i.e., imbibing, one or more nonaqueous organic liquids such as the liquid hydrocarbon fuels of the present invention. Generally, these polymers are swellable by any organic liquid which is a solvent for the polymer's linear analogue.

It is particularly advantageous for optimum efficiency of the polymer that the solubility parameter of the liquid hydrocarbon fuel and the polymer match. Solubility parameters are described by Hildebrand and Scott in *The Solubility of Nonelectrolytes,* Reinhold, 1949, and by H. Burrel in "Solubility Parameters," Interchemical Review, vol. 14, pages 3 and 31, 1955. Methods for tailoring polymers to achieve a desired solubility parameter are known in the art.

Preferably, lightly cross-linked polymers and copolymers of alkylstyrenes are utilized as the imbibing agent in the process of this invention. Those alkylstyrenes which can be used to prepare these polymers have alkyl groups containing from 1 to 20, preferably from 4 to 12 carbon atoms, such as: tertiary-alkylstyrenes including, for example, p-tert-butylstyrene, p-tert-amylstyrene, p-tert-hexylstyrene, p-tert-octylstyrene, p-tert-dodecylstyrene, p-tert-octadecylstyrene, and p-tert-eicosylstyrene; n-alkylstyrenes including for example, n-butylstyrene, n-amylstyrene, n-hexylstyrene, n-octylstyrene, n-dodecylstyrene, n-octadecylstyrene, and n-eicosylstyrene; sec-alkylstyrenes including for example, sec-butylstyrene, sec-hexylstyrene, sec-octylstyrene, sec-dodecylstyrene, sec-octadecylstyrene, and sec-eicosylstyrene; isoalkylstyrenes, including for example, isobutylstyrene, isoamylstyrene, isohexylstyrene, isooctylstyrene, isododecylstyrene, isooctadecylstyrene, and isoeicosylstyrene; and copolymers thereof.

Suitable monomers which may be employed as comonomers with the alkylstyrene include such materials as styrene, vinyltoluenes, ring substituted $\alpha$-methylstyrenes, arylstyrenes and alkarylstyrenes; methacrylic esters, acrylic esters, vinyl esters of aliphatic carboxylic acids, alkyl vinyl ethers, alkyl vinyl ketones, $\alpha$-olefins, isoolefins, butadiene, isoprene, dimethylbutadiene, and the like.

Especially preferred for use in the practice of the invention are cross-linked copolymers of such alkylstyrenes as heretofore described and an alkyl ester derived from a $C_1$ to $C_{24}$, advantageously greater than $C_8$, alcohol and an acrylic or methacrylic acid or a mixture thereof. It is preferred that the copolymers contain at least 50 mole percent alkylstyrene. Optimumly, the polymer comprises about 70 mole percent p-tert-butylstyrene and 30 mole percent long chain (derived from a $C_8$ or greater alcohol) acrylate and methacrylate esters.

It is desirable that the polymers used as imbibing agents contain a slight amount of cross-linking agent, preferably in the range of from about 0.01 to 1 percent by weight. The most efficient imbibition occurs when the level of cross-linking agent is less than 1 percent by weight since this permits the polymers to swell easily and imbibe a substantial volume of the liquid hydrocarbon fuel. Cross-linking agents which can be used in preparing the imbibing polymers suitable for use in the present invention include polyethylenically unsaturated compounds such as divinylbenzene, diethylene glycol dimethacrylate, diisopropenylbenzene, diisopropenyldiphenyl, diallyl maleate, diallyl phthalate, allyl acrylates, allyl methacrylates, allyl fumarates, allyl itaconates, alkyd resin types, butadiene or isoprene polymers, cyclooctadiene, methylene norbornylenes, divinyl phthalates, vinyl isopropenylbenzene, divinyl biphenyl, as well as any other di- or poly-functional compound known to be of use as a cross-linking agent in polymeric vinyl-addition compositions. Normally, the polymer containing the cross-linking agent swells with the imbibed liquid hydrocarbon fuel. If there is too much cross-linking agent the imbibition takes an unreasonably long time and the polymer is unable to imbibe a sufficient quantity of the liquid fuel, thus reducing the effectiveness of the polymer as an imbiber. If the imbibitional polymer contains no cross-linking agent or too little cross-linking agent, then it will dissolve in the liquid fuel resulting, for example, in a nondiscrete, nonparticulate mass of polymer-thickened liquid hydrocarbon fuel.

The imbibing polymers used in the practice of this invention can be obtained by polymerization in solution, suspension, mass, or a coil reactor according to processes known in the art. These polymers are particulate in nature, becoming discrete, swelled polymer particles after imbibing the liquid hydrocarbon fuel. Preferably, the polymer particles are obtained by polymerization in suspension, since particles prepared in that manner have a greater capacity to swell, sometimes to as much as fifty times their original volume. The size of the polymer particle can vary so long as the swollen size is such that it can pass through a burning apparatus, for example.

The particular advantage of using an organic liquid-swellable, organic liquid-insoluble polymer in combination with a slurry of carbonaceous material and liquid hydrocarbon fuel is that the polymer particles generally retain their distinct shape and character when swollen by imbibing the liquid fuel. These swollen polymer particles will settle from the slurry along with the carbonaceous material and come to rest amid the slurry sediment, thereby effectively interrupting the packing efficiency of the sediment so that it is readily redispersible when agitated. Under shear conditions the swollen polymer particles may become torn and indiscriminate in shape, but their capacity to interrupt the packing efficiency of the slurry sediment will not be impaired.

The degree of swelling of the imbibing polymer particles, as well as the amount of polymer particles used to imbibe the liquid hydrocarbon fuel, depends upon the type of liquid fuel to be imbibed, the polymer composition, and the extent to which the polymer is cross-linked. Additionally, the amount of polymer particles to be added to the slurry in the practice of this invention depends significantly upon the relative proportions of liquid fuel and solid carbonaceous material within the slurry, i.e., the amount of liquid fuel to be imbibed, as well as the absorbing capacity and size of the particular carbonaceous material used. Generally, a greater proportion of liquid hydrocarbon fuel in a slurry will require a greater amount of imbibing polymer. Normally, the amount of imbibing polymer will range from about 0.1 to about 2.5 weight percent, based on the weight of liquid hydrocarbon fuel. The actual amount of imbibing polymer required for a particular slurry can readily be determined by simple experimentation: The amount of a particular liquid fuel which can be absorbed by a certain size and type of carbonaceous material is determined by standard methods. Having determined the absorbency of the carbonaceous material used, one can predict the volume of free liquid which will be present in a slurry containing that carbonaceous material. In a similar manner, one can determine the imbibing capacity of the polymer to be used by measuring the oil volume imbibed by an arbitrarily selected but known weight of polymer. Thus, the weight of polymer required to imbibe all the free liquid in the slurry can be calculated. Knowing this, one can adjust the relative amounts of the liquid fuel, carbonaceous material, and polymer so as to obtain the desired results. By imbibing substantially all the free liquid within the slurry, the problems arising from sedimentation are essentially eliminated. Total imbibition is not required in order to beneficially modify the slurry, however, and the user may wish to retain some free oil within the slurry. When used in the amount suggested, the polymer particles do impart some thixotropic properties to the resulting slurry, but not to the extent of total gelation. When the polymer particles are used in an amount greater than that suggested, e.g., from about 3 to about 10 weight percent of the liquid hydrocarbon fuel, the slurry can be completely gelled. Such a result, however, is not contemplated by the present invention, since the preferred slurry is one that remains essentially mobile.

Composite fuels in accordance with the present invention are readily prepared by adding polymer particles to a liquid hydrocarbon fuel/solid carbonaceous material slurry. The mixture is then stirred or otherwise agitated until imbibing is substantially complete. Alternatively, the polymer particles may be preswollen with the same or a different liquid fuel, such as one less viscous than the main liquid fuel component, and added in monitored fashion to a slurry of solid and liquid fuels. Most advantageously, the slurries are prepared by mixing dry polymer particles and carbonaceous material, and then adding this mixture to the liquid hydrocarbon fuel with agitation. If desired, the admixing of slurry and polymer particles may be carried out at elevated temperatures to hasten thorough mixing thereof, e.g., when a viscous liquid fuel is used. Other variations and combinations are possible.

The following specific examples illustrate the invention but are not to be taken as limiting its scope. Parts and percentages are by weight unless otherwise indicated or required by context.

EXAMPLE 1

Two slurry samples were prepared consisting of 40 parts cleaned bituminous coal of medium volatility, with 80% passing through a 325 mesh screen, and 60 parts #2 fuel oil having a viscosity of 3 cp at room temperature. Free-radical suspension polymerized copolymer particles of 70% t-butylstyrene/20% 2-ethylhexyl acrylate/10% cetyl-eicosyl methacrylate cross-linked with 0.05% divinylbenzene were added to one sample in an amount of 0.2 part, and the mixture was stirred for 120 minutes until imbibition was complete.

The appearance of a yield value within the slurry before settling takes place is an indication of the resistance to sedimentation. The sample without polymer particles had no yield value whereas the sample containing the imbibing polymer particles had a yield value of 21 dynes/cm$^2$. Yield values were measured with a Rotovisco RV-3 with MVI cup and bob on the K-3 scale.

After standing 55 days, the control sample had a very hard, compact sediment while the sample containing polymer particles had a sediment of grease-like consistency which was easily redispersible in the slurry.

EXAMPLE 2

As an experiment to test the effect of varying the method of adding polymer particles to a slurry, a stock solution was prepared from 5 parts of the imbibing polymer particles used in Example 1, and 95 parts of the fuel oil used in Example 1. The mixture was a mobile, pumpable gel capable of further imbibition upon adding to a slurry. Four parts of the prepared stock solution was added to a slurry of 40 parts coal and 56 parts fuel oil so as to obtain the same composition as the sample in Example 1, and the mixture was shaken for one minute. Settling results were substantially the same as those obtained in Example 1 for the polymer-containing sample.

EXAMPLE 3

In a series of experiments, slurry samples were prepared containing 40 parts of the coal and 60 parts of the fuel oil used in Example 1, and 0.5 part (0.83 percent of the fuel oil weight) suspension polymerized polymer particles (beads) which were preswollen with fuel oil before being added to the slurry. After allowing the samples to stand undisturbed for 5 days, the samples were measured for reduction in settling, by comparing them to a control sample which did not contain polymer particles. "Percent settling reduction" is defined as $$\frac{(V_B - V_S)}{V_B} \times 100$$

where $V_B$ is the volume of free oil appearing above the sediment formed in the blank or control sample, and $V_S$ is the volume of free oil appearing above the sediment formed in the sample containing an additive. Consequently, by definition, a control sample will have no settling reduction, and a sample in which no free oil forms above the sediment will show a 100 percent settling reduction.

TABLE I

| Sample | Bead Composition[1] | Bead Imbibing Capacity[2] (cc/g) | Percent Settling Reduction |
|---|---|---|---|
| 3.1[3] | None | | 0 |
| 3.2[3] | 100 S/0.05 DVB | 1 | 6 |
| 3.3[3] | 80 S/20 CEMA/0.035 DVB | 4 | 12 |
| 3.4 | 75 VT/25 CEMA/0.072 DVB | 18 | 19 |
| 3.5 | 70 VT/30 LMA/0.72 DVB | 22 | 25 |
| 3.6 | 70 TBS/30 CEMA/0.05 DVB | 32 | 25 |
| 3.7 | 100 TBS/0.05 DVB | 30 | 35 |
| 3.8 | 70 TBS/30 EHA/0.07 DVB | 35 | 65 |
| 3.9 | 70 TBS/20 EHA/10 CEMA/0.05 DVB | 40 | 63 |
| 3.10 | 70 TBS/30 LMA/0.05 DVB | 45 | 65 |

Notes:
[1]CEMA = mixture of cetyl and eicosyl methacrylates
DBV = divinylbenzene
EHA = 2-ethylhexyl acrylate
LMA = lauryl methacrylate
S = styrene
TBS = tert-butylstyrene
VT = vinyltoluene
[2]Volume of #2 fuel oil imbibed by 1 g beads
[3]Control - not an example of the invention The results shown in Table I, demonstrate the relationship between the imbibing capacity of the polymer particles and the degree of settling of carbonaceous material in a slurry containing such particles. Generally, those beads which have the greatest imbibing capacity will have the greatest effect on the degree of settling.

EXAMPLE 4

In a series of experiments, slurry samples were prepared containing varying proportions of the fuel oil and coal used in Example 1, and polymer particles comprising 70 parts tert-butylstyrene, 20 parts 2-ethylhexyl acrylate, 10 parts of mixture of cetyl and eicosyl methacrylates, and 0.05 part divinylbenzene. The polymer particles were prepared by free-radical suspension polymerization to obtain beads having average diameter of 300 microns. In these experiments, the dry beads were first mixed with the pulverized coal, so that the beads would be separated and free to imbibe to their maximum capacity without adhering to one another, and the mixture was then added to the fuel oil. The slurry was intermittently shaken over a period of about 25 minutes until imbibition was complete. The slurry samples were allowed to stand undisturbed for 5 days, after which time the samples were compared for percent settling reduction. The results are shown in Table II.

TABLE II

| Sample | Composition[1] (Coal:Oil:Beads) | Free Oil[3] (cc) | Percent Settling Reduction |
|---|---|---|---|
| 4.1[2] | 100:100:0 | 21 | 0 |
| 4.2 | 100:99:1 | 0 | 100 |
| 4.3[2] | 100:150:0 | 70 | 0 |
| 4.4 | 100:140:1.25 | 20 | 71 |
| 4.5 | 100:147.5:2.5 | 0.1 | 99.9 |
| 4.6[2] | 100:233:0 | 168 | 0 |
| 4.7 | 100:233:2 | 87 | 48 |
| 4.8 | 100:229:4 | 12 | 93 |

Notes:
[1]Parts by weight
[2]Control - not an example of the invention
[3]Volume of oil appearing above sediment after storage of slurry sample for 5 days These results demonstrate the relationship between the degree of settling and the relative proportions of carbonaceous material, liquid fuel, and polymer particles in the slurry. The volume of free liquid which will appear above the sediment in a slurry is generally predictable, as shown in Table II, due to the characteristic absorbency of the carbonaceous material, and the characteristic imbibing capacity of the polymer particles used.

The absorbency of the carbonaceous material is in part dependent upon particle size. For example, when the coal is ground so that about 80% passes through a 200 mesh screen, instead of 80% through 325 mesh screen as used in this Example, the amount of free oil appearing above the sediment increases by a factor of three, thereby necessitating a three-fold increase in the amount of polymer particles to achieve the same percent settling reduction. Consequently, it is necessary for the user to balance the benefits of further grinding of the carbonaceous material (which would reduce the amount of polymer required) against the additional cost of such grinding.

What is claimed is:

1. An improved mobile and combustible fuel slurry comprising solid particulate carbonaceous material, liquid hydrocarbon fuel, and a particulate cross-linked organic liquid-swellable, organic liquid-insoluble polymer, wherein the polymer is composed of at least 50 mole percent of at least one alkylstyrene wherein the alkyl groups contain from 1 to 20 carbon atoms.

2. The slurry of claim 1 wherein the polymer is a product of a suspension polymerization reaction.

3. The slurry of claim 1 wherein the amount of polymer ranges from about 0.1 to about 2.5 weight percent, based on the liquid hydrocarbon fuel weight.

4. The slurry of claim 1 wherein the alkylstyrene is vinyltoluene.

5. The slurry of claim 1 wherein the alkylstyrene is tert-butylstyrene.

6. The slurry of claim 1 wherein the polymer is a copolymer of the alkylstyrene and at least one alkyl ester of acrylic acid or methacrylic acid.

7. The slurry of claim 6 wherein the alkyl ester is a mixture of cetyl and eicosyl methacrylates.

8. The slurry of claim 6 wherein the alkyl ester is 2-ethylhexyl acrylate.

9. The slurry of claim 6 wherein the alkyl ester is lauryl methacrylate.

10. A process for preparing a mobile and combustible fuel slurry which comprises admixing solid particulate carbonaceous material, liquid hydrocarbon fuel, and a particulate cross-linked organic liquid-swellable, organic liquid-insoluble polymer, wherein the polymer is composed of at least 50 mole percent of at least one alkylstyrene wherein the alkyl groups contain from 1 to 20 carbon atoms.

* * * * *